US006729475B2

(12) United States Patent
Yuhas et al.

(10) Patent No.: US 6,729,475 B2
(45) Date of Patent: May 4, 2004

(54) SHIPPER AND DISPLAY CARTON

(75) Inventors: Andrew Yuhas, Towaco, NJ (US); Len La Plante, Jamesburg, NJ (US); Leonard Beer, Pleasantmount, PA (US)

(73) Assignee: Colgate-Palmolive Company, New York, NY (US)

( * ) Notice: Subject to any disclaimer, the term of this patent is extended or adjusted under 35 U.S.C. 154(b) by 0 days.

(21) Appl. No.: 10/075,420

(22) Filed: Feb. 14, 2002

(65) Prior Publication Data

US 2002/0070145 A1 Jun. 13, 2002

Related U.S. Application Data

(62) Division of application No. 09/729,932, filed on Dec. 5, 2000, now Pat. No. 6,386,369.

(51) Int. Cl.[7] ..... B65D 1/22; B65D 25/04

(52) U.S. Cl. ..... 206/746; 206/747; 206/750; 229/120.03; 229/120.08

(58) Field of Search ..... 206/746, 738, 206/739, 745, 747, 749, 750; 229/120.03, 120.08, 120.11, 120.011, 120.17, 120.13, 120.18, 240, 242; 493/310

(56) References Cited

U.S. PATENT DOCUMENTS 1,925,102 A * 9/1933 Levkoff ..... 206/746
4,000,811 A * 1/1977 Hardison et al. ..... 229/242
4,588,084 A * 5/1986 Holley, Jr. ..... 229/240
4,913,291 A * 4/1990 Schuster ..... 229/120.11
4,919,269 A * 4/1990 Wright et al. ..... 229/120.011
5,012,929 A * 5/1991 Roosa ..... 229/120.011
5,048,690 A * 9/1991 Zimmerman ..... 206/746
5,505,370 A * 4/1996 Brown et al. ..... 229/120.11

* cited by examiner

*Primary Examiner*—Mickey Yu
*Assistant Examiner*—Gregory Pickett
(74) *Attorney, Agent, or Firm*—Michael J. McGreal

(57) ABSTRACT

The carton can be used both as a shipper carton and a display carton. The carton comprises two or more channels for containing products. The channels can be opened to maintain the integrity of the carton for use as a display carton by maintaining the integrity of the base wall, but with the removal of substantially all of the top wall of each channel and a significant portion of the sidewalls of each channel. The remaining part of the sidewalls, a rear wall and the base provide the structure for the use of the carton as a display carton. If used as a shipper, a tear strip on the base wall is removed and the carton fully opened and emptied. The carton is made from a unique carton blank and a unique folding of the panels of the blank to make the carton. In particular the abutting walls of the channels are of a unique structure with each having a separate sidewall and these separate sidewalls not connected to the base wall.

6 Claims, 4 Drawing Sheets

SHIPPER AND DISPLAY CARTON

This is a divisional of application Ser. No. 09/729,932, filed Dec. 5, 2000, now U.S. Pat. No. 6,386,369.

FIELD OF THE INVENTION

This invention relates to a carton that has the dual function of being a shipper carton and a display carton. More particularly, this invention relates to a carton for a plurality of generally rectangular articles where the carton can be opened for he removal of all articles or it can be opened so as to display the articles at a point of sale and for removal of articles one at a time by purchasers.

BACKGROUND OF THE INVENTION

Products are placed into shipping cartons for transport from the place of manufacture to the point of sale. Such shipping cartons are of a corrugate fiberboard of sufficient integrity to withstand the rigorous handling during storage and transport. During these times the cartons are stacked on pallets and at times one pallet stacked onto another. In addition, the cartons may be dropped from a height of six feet or more. In all of this handling and storage, the carton as a shipper package must protect the packaged articles from damage.

In addition, to use as a shipping carton, it is useful if this same carton can be used to display the articles at the point of sale. In order to be a good display carton it must be consistently operable in a particular manner. Further, it must hold the articles in a manner so that they are effectively displayed. To be effectively displayed the purchase must be able to see substantially all of the front surface of the article. This includes a view of substantially all of the trademarks and trade dress.

In the present instance the most preferred articles to be placed into the carton are antiperspirant and deodorant products. These are in oval to rectangular packages. These products have rigid containers with the trademarks and trade dress on the front surface of the antiperspirant and deodorant containers.

The shipper and display carton of the present invention solves the problem of a dual function carton for articles of a shape of antiperspirant and deodorant sticks. The carton can be opened easily to remove all of the articles, or it can be opened so that it holds the articles in place and displays the articles at the point of sale. This carton can contain multiple aligned channels which hold and display an article. The carton is produced from a single carton blank through a series of folds. The net result is an aid to the retailer at the point of sale.

BRIEF DESCRIPTION OF THE INVENTION

This invention is directed to a dual function carton, the carton blank from which the dual function carton is made, and the method of making the dual function carton from the carton blank. The carton has a plurality of channels for containing the articles. The articles are contained in each channel in a row. In a preferred mode the carton is comprised of two channels having a common base, each channel having one exterior sidewall and one adjacent sidewall, and seal flaps closing each end of each channel. The adjacent sidewalls are attached at their base and are adjacent to a tear strip in the base of the carton. On the top panel of each channel there is a pull tab for the removal of substantially all of the top panel and a significant portion of each side panel of each channel. In this mode a large portion of a channel is opened with the articles then being displayed in a neat and orderly fashion. When the carton is emptied it is replaced with another carton.

The channels also can be separated so that the articles in each channel can be displayed separately. This is accomplished by removing the tear strip in the base panel and severing the channels, one from the other. The pull tab for each channel is pulled and a substantial portion of the top panel and a significant portion of each sidewall of each channel is removed for the separate display of the articles in each channel. One channel of articles can be stored and displayed at a later time.

If the carton is not to be used as a display carton, it is opened by means of a tear strip on the base panel which opens all channels of articles at once. The articles then are quickly removed and placed on a shelf for display and sale.

The carton is made from a single carton blank. The carton blank has as a contiguous arrangement, a bottom panel with an approximately medial tear strip, a first channel sidewall panel, a first channel top wall panel, a first channel other sidewall panel, a second channel sidewall panel, a second channel top wall panel, and a second channel other sidewall panel. Attached to the base panel to which the described panels are attached in a contiguous arrangement, there is a glue flap. On the transverse ends of each panel there are seal flaps for closing the folded carton. The first channel top wall panel and second channel top wall panel each have a pull tab for the removal of substantially all of each top wall panel and a significant portion of each sidewall panel. This is for opening the carton for use as a display carton. If the objective is to fully open the carton for the removal of all articles, the tear strip in the base panel is removed which automatically opens each channel of articles.

The shipper and display carton is formed from the carton blank by folding the first channel sidewall panel upwards at about a 90° angle and then folding the top wall panel inwardly over the base panel at about a 90° angle. The first channel other sidewall panel then is folded downwardly toward the base panel at an angle of about 90°. The second channel sidewall panel is folded upwardly at an angle of about 180° with the second channel top wall panel folded outwardly about parallel to the base panel. The second channel other sidewall panel is folded downwardly at an angle of about 90° toward the base panel and is attached to the glue flap. When the articles are within the channels, the seal flaps are folded over onto each other and glued into place where needed to close the carton, but not to interfere in opening the carton in any mode.

The carton is opened depending on whether it also is to be used as a display carton. If it is to be used as a display carton, the pull tab on each channel is pulled to remove substantially all of the top wall panel and a significant portion of each sidewall panel of each channel. This can be while the channels are interconnected or if the channels have been separated. The carton or a separated channel then is placed on the shelf. Optionally the carton can be fully opened by removing the base panel tear strip which fully opens each channel so that the articles can quickly be removed.

The carton can be made of a paperboard or fiberboard. Preferably it is a corrugated paperboard.

DETAILED DESCRIPTION OF THE DRAWINGS

The present shipper and display carton will be described in a preferred mode with reference to the drawings. It is produced from one carton blank that has a plurality of contiguous wall panels. By the use of particular score lines and fold points, the carton is assembled from the blank. Once formed into the carton, filled and sealed, it can be opened to fully dispense the articles or to display the articles at a point of sale.

Figure 1:
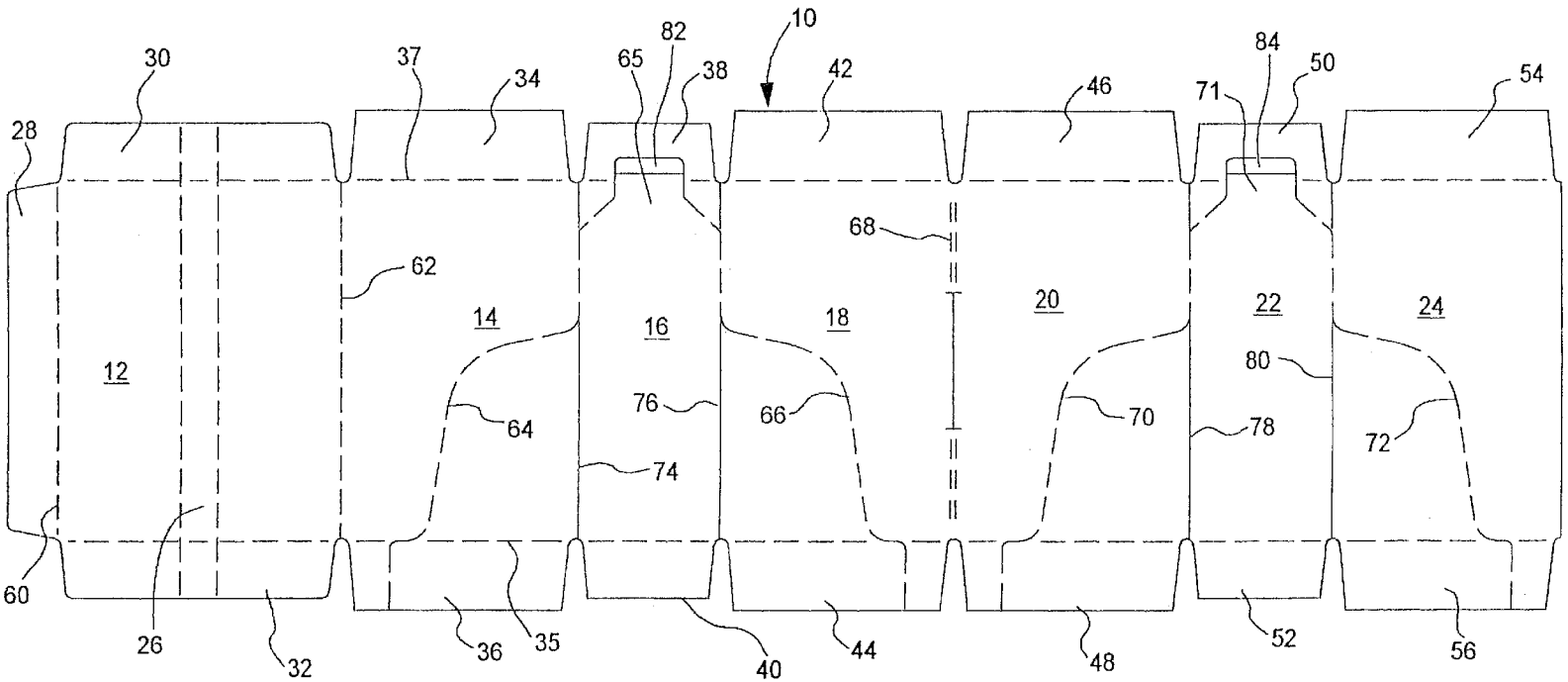
FIG. 1 is a top plan view of the carton blank for the shipper and display carton.

FIG. 1 is a top plan view of the carton blank. The carton blank is comprised of base panel 12 which has a tear strip 26 transversely across about a mid portion of the base panel. On the ends of the base panel there are seal flaps 30 and 32 with the tear strip 26 traversing these seal flaps. On one side of the base panel is glue flap 28 with the perforated line 60 forming the fold point between the glue flap and base panel. Attached to the base panel opposite the glue flap is first channel sidewall 14 with a fold made at perforated line 62. The first channel sidewall has seal flaps 34 and 36. Attached to the first channel sidewall panel is first channel top panel 16 which has appended seal flaps 38 and 40 and a grip opening 82. This first channel top panel is delineated by fold lines 74 and 76. Contiguous with the first channel top wall panel is first channel other sidewall panel 18. This other sidewall panel has appended seal flaps 42 and 44. Shown on the first channel wall panels are score lines 64 and 66 which delineate pull tab 65. These score lines start adjacent the seal flap 38 on the first channel top wall panel 16 and respectively extend down and across first channel sidewall panel 14 and seal flap 36 and other sidewall panel 18 and seal flap 44. This part of the first channel delineated by the perforated lines is removed to display the articles when the carton is used as a display carton.

Contiguous with first channel other sidewall panel 18 is second channel sidewall panel 20 which has attached seal flaps 46 and 48. This sidewall panel is connected by hinge fold 68 to the first channel other sidewall panel. Contiguous with this second channel sidewall panel 20 is second channel top wall panel 22 which has appended seal flaps 50 and 52 and a grip opening 84. Attached to this top wall panel is second channel other sidewall panel 24 with appended seal flaps 54 and 56. Fold lines 78 and 80 form the edge of the second channel top wall panel.

As with the first channel top wall panel, there is a pull tab. This pull tab 71 is delineated by score lines 70 and 72. This pull tab will remove a substantial portion of second channel top wall panel 22 and significant portions of the second channel sidewall panel 20 and the second channel other sidewall panel 24. The carton then is used to display the contained articles at the point of sale.

Figure 2:
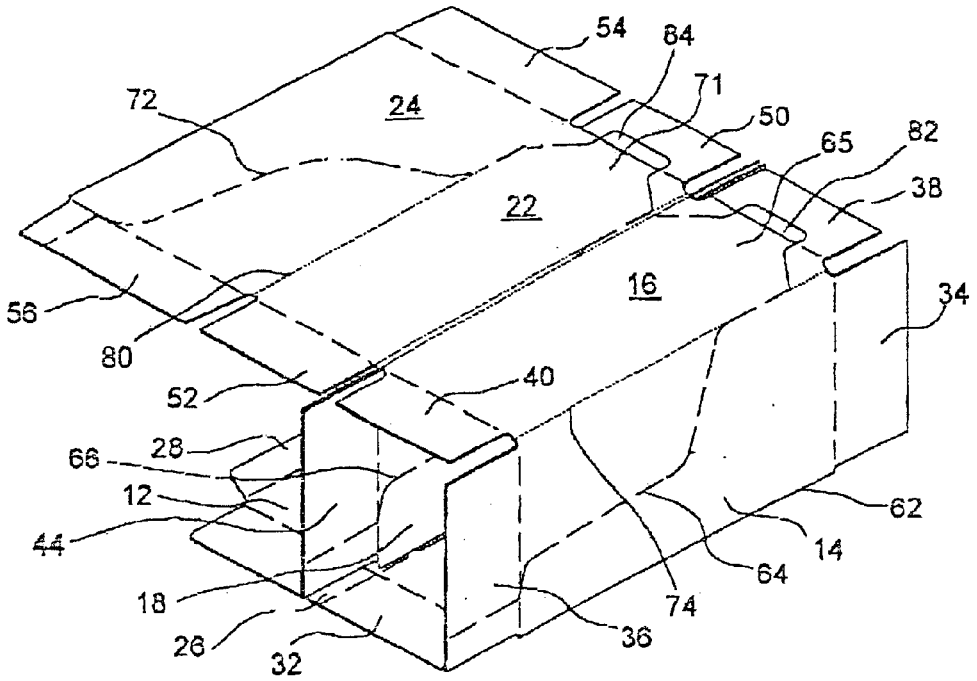
FIG. 2 is a perspective view of the carton of FIG. 1 with the panels folded to form the first channel.

FIG. 2 shows the carton partially formed from the carton blank of FIG. 1. In this view the first channel is formed with the second channel being partially formed. There is shown base panel 12 with seal flap 32 and tear strip 26. Panel 14 forms the first channel sidewall, panel 16 the first channel top wall and panel 18 the first channel other sidewall. It is seen that the blank is folded at 62 to form the first channel sidewall panel and at 74 to form the top wall panel. The first channel other sidewall panel 18 is seen to complete the first channel. The second channel sidewall panel 20 is adjacent, and substantially parallel to first channel other sidewall panel 18. Second channel top panel 22 and second channel other sidewall panel 24 are shown unfolded in the assembling of the carton. The various seal flaps as described above are shown but are open until articles are filled into the channel. Score lines 64 and 66 delineate where pull tab 65 will sever from the carton to open the carton for display use.

Figure 3:
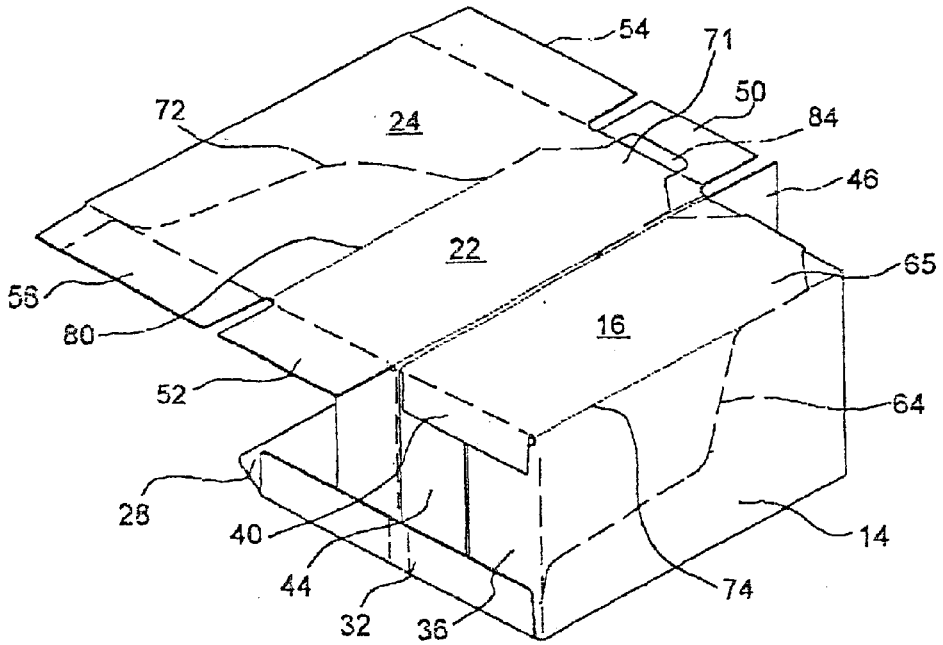
FIG. 3 is a perspective view of the carton of FIG. 1 showing the first channel closed.

FIG. 3 shows the first channel closed after being filled with articles. The seal flaps (those shown are 32, 34, 36, 38, 40, and 42). This view gives an indication of how the first channel appears in a filled and sealed condition.

Figure 4:
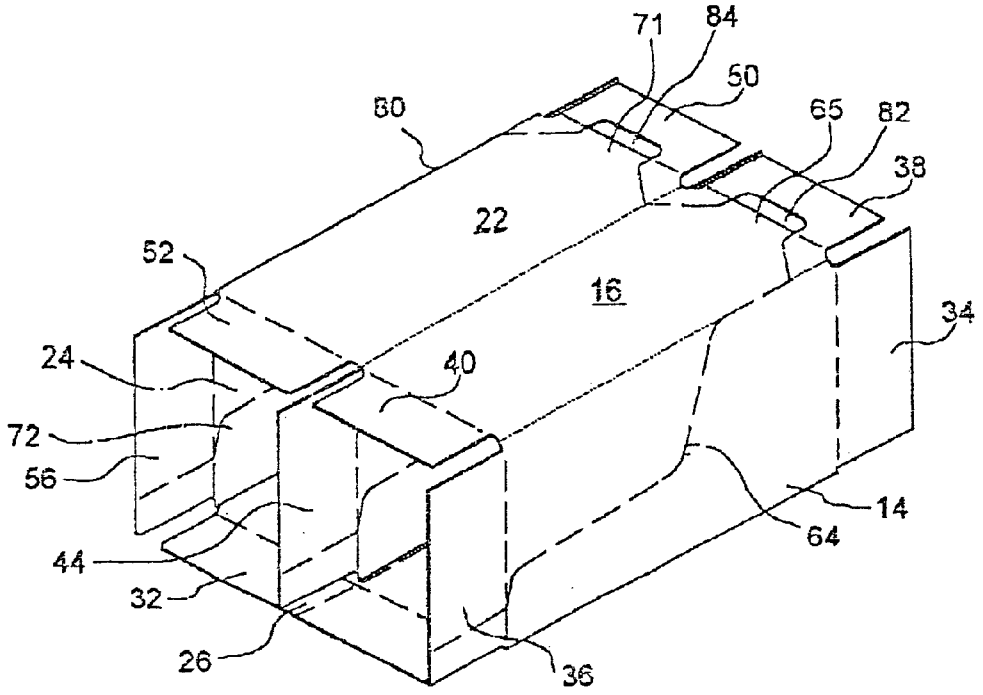
FIG. 4 is a perspective view of the carton of FIG. 1 showing the two channels formed and ready to receive articles.
Figure 5:
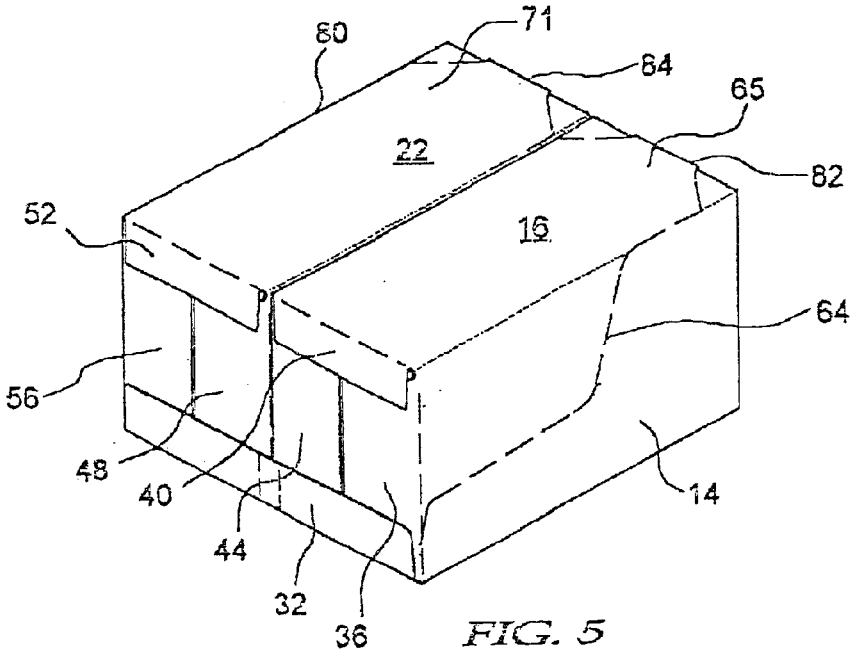
FIG. 5 is a perspective view of the shipper and display carton of FIG. 1 filled with articles and fully sealed.

FIG. 4 shows the carton of FIG. 2 with the two channels fully formed, but with the end seal flaps of both channels open. The articles to be packaged can be placed into each channel. This is formed from the partially formed carton of FIG. 2 by folding other sidewall panel other sidewall along fold line 80 to form the second channel. This other sidewall panel is folded downwardly at about a 90° angle to be adjacent to the base panel 12. The glue flap 28 then is folded upwardly and attached onto the exterior surface of other sidewall flap 24 which fully forms the second channel. In order to close the carton, after filling the sidewall end flaps of each channel are folded over followed by the top wall end flaps and the base panel end flaps. The top wall end flaps and the base panel end flaps are adhesived to the sidewall end flaps to maintain the flaps closed. The fully closed carton is shown in FIG. 5. This shows all of the end flaps closed and the carton sealed.

Figure 6:
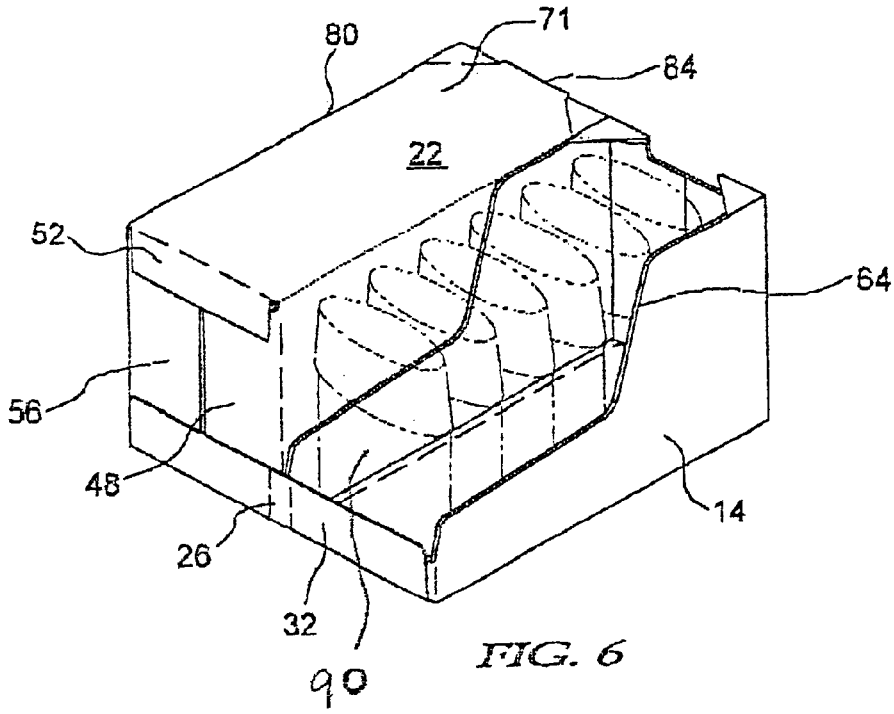
FIG. 6 is a perspective view of the shipper and display carton of FIG. 5 with a channel opened for the display of articles.

FIG. 6 shows the pull tab 65 removed along perforations 64 and 66 to show the contained articles 90 displayed in the first channel. In display use both channels would be opened. Here for illustrative purposes one is shown to be open.

Figure 7:
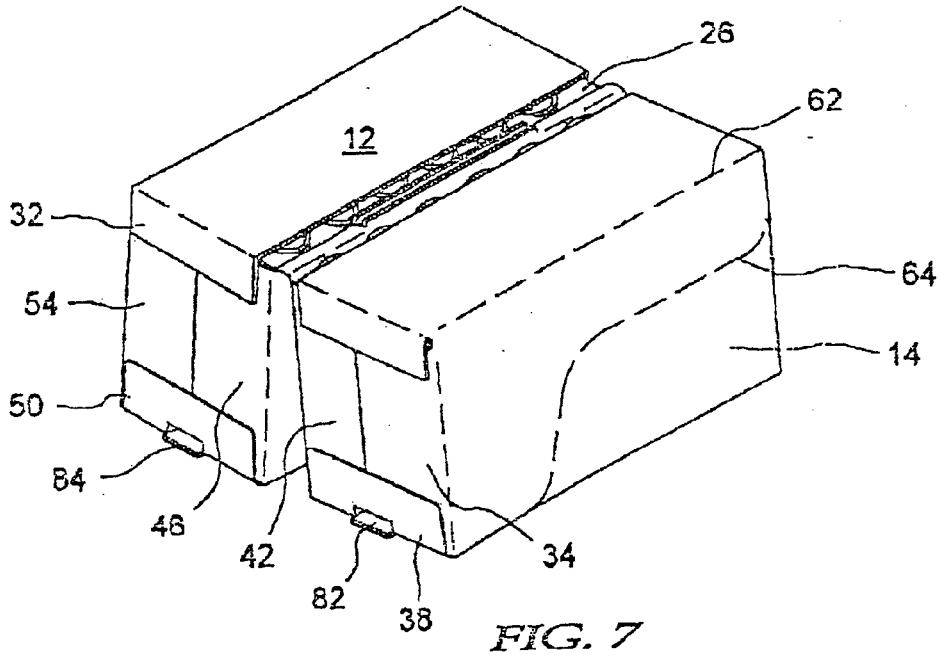
FIG. 7 is a perspective view of the shipper and display carton of FIG. 5 opened to remove all of the articles.

FIG. 7 shows the carton of FIG. 5 inverted and tear strip 26 removed. The bottom of each channel new opens and all of the articles are removed. All of the articles are removed in this embodiment since the integrity of the carton has been lost. Panels 18 and 20 move downwardly as the channels are moved outwardly away one from the other.

As shown in FIG. 6, one of the channels has been opened. The channels of FIG. 6 also may be separated and displayed separately. This is accomplished by removing the tear strip 26 and separating one channel from the other. This allows the merchant to put on the shelf fewer of each variant of a product on the shelf. One channel can be put on display and the other in storage.

As can be seen the carton can be used in two different modes. This is unique. It is a shipper carton since it protects the packages articles during transport. It is a display carton since upon removal of substantially all of the top panel of each channel, and a significant part of each sidewall of each channel, the contained articles are displayed in an orderly array. A useful material to construct the carton is a fiberboard, and preferably a corrugated fiberboard.

The foregoing description describes the preferred mode of the present shipper and display carton. Variations and modifications of the described concept are considered to be within the present invention.

What is claimed is:

1. A shipper/display carton blank for producing a shipper/display carton having separate product channels comprising a contiguous blank comprised in a longitudinal dimension of a base panel, a first channel sidewall panel attached to said base panel, a first channel top panel attached to said first channel sidewall panel, a first channel other sidewall panel attached to said first channel top panel, a second channel sidewall panel attached to said first channel other sidewall panel, a second channel top panel attached to said second channel sidewall panel, and a second channel other sidewall panel attached to said second panel top wall panel, each of said panels having at least one flap on each transverse end, said base panel having a tear strip about medially transversely across said base panel, and a null tab on said first channel top panel, said null tab comprising score lines extending into said first channel sidewall panel and said first channel other sidewall panel.

2. A shipper/display carton blank as in claim 1, wherein said carton blank has a longitudinal dimension and said base panel has a glue flap on a longitudinal end of said carton blank.

3. A shipper/display carton blank as in claim 1 including a pull tab on said second channel top panel, said pull tab score lines extending onto said second channel sidewall panel and said second channel other sidewall panel.

4. A method of forming a shipper/display carton comprising:

providing a carton blank including in a contiguous array a base panel, a first channel sidewall panel, a substantially removable first channel top panel, a first channel other sidewall panel, a second channel sidewall panel, a substantially removable second channel top panel and a second channel other sidewall panel said base panel having a transverse glue flap on a side opposite said first channel sidewall panel;

folding said first channel sidewall panel upwardly at an angle of about 90° to said base panel, said top panel outwardly at an angle of about 90° to said first channel sidewall panel, and said first channel other sidewall panel downwardly at an angle of about 90° to said first channel top panel to a position adjacent to said base panel to form a first channel of said shipper/display carton;

folding said second channel sidewall panel upwardly at a fold at an angle of about 90° to said base panel, said second channel top panel outwardly at an angle of about 90° to said second channel sidewall panel and said second channel other sidewall panel downwardly at an angle of about 90° to said second channel top panel to a position adjacent said base panel to form a second channel of said shipper/display carton; and attaching said transverse glue flap to said second channel other sidewall panel to form a first channel and a second channel of said shipper and display carton.

5. A method of forming a shipper/display carton as in claim 4 comprising forming a score line on said first channel top panel extending at least partially down and across said first channel sidewall panel and said first channel other sidewall panel, and forming a score line on said second channel top panel extending at least partially down and across said second channel sidewall panel and said second channel other sidewall panel.

6. A method of forming a shipper/display carton as in claim 5 herein each panel has attached flaps and comprising overlapping and adhesively sealing adjacent flaps to close said carton.

* * * * *